United States Patent [19]

Palmer et al.

[11] Patent Number: 4,489,585

[45] Date of Patent: Dec. 25, 1984

[54] PRODUCTION OF TUBULAR MEMBERS

[75] Inventors: Nicholas J. Palmer, Islip; Anthony R. H. Pocock, Medbourne, both of England

[73] Assignee: British Steel Corporation, England

[21] Appl. No.: 447,189

[22] Filed: Dec. 6, 1982

[30] Foreign Application Priority Data

Dec. 11, 1981 [GB] United Kingdom ..... 8137531

[51] Int. Cl.[3] ..... B21D 9/05

[52] U.S. Cl. ..... 72/387; 72/370; 72/112; 29/157 A

[58] Field of Search ..... 72/387, 386, 388, 369, 72/370, 378, 298, 112, 125; 29/157 A; 219/6.5, 8.5

[56] References Cited

U.S. PATENT DOCUMENTS

| | | | |
|---|---|---|---|
| 1,324,940 | 12/1919 | Theborath | 72/465 |
| 1,903,436 | 4/1933 | Brown | 72/388 |
| 1,978,452 | 10/1934 | Flodin | 29/157 A |
| 2,134,853 | 11/1938 | Boissou | 29/157 A |
| 3,453,857 | 7/1969 | Reckard | 72/369 |

*Primary Examiner*—Daniel C. Crane
*Assistant Examiner*—David B. Jones
*Attorney, Agent, or Firm*—Bacon & Thomas

[57] ABSTRACT

The invention provides an arrangement for forming an elbow in a length of pipe comprising two internal die pins each mounted for rotation, as limbs of cranked assemblies, about the same axis, the internal die pins being angled with respect to the axis of rotation and meeting each other in surfaces lying in a plane normal to the axis of rotation, the surfaces being intersected by said axis of rotation; means for contra-rotating the cranked assemblies from a position at which the die pins are co-axial to a position at which they are aligned at a pre-determined angle with respect to each other.

10 Claims, 8 Drawing Figures

PRODUCTION OF TUBULAR MEMBERS

This invention relates to the production of tubular members, and more particularly to apparatus for and methods of forming an elbow fitting for use in pipework.

By elbow fitting as used herein we mean a short length of pipe or tube incorporating, over a very limited portion of its length, a sharply defined bend of any useful magnitude between 0° and 180°. Common practice is that elbows are produced having angles of 30°, 45°, 60° and 90°.

Elbows as hereinabove defined are frequently preferred, when changing direction in pipelines, over a more gradually curved bend fitting because of the greater compactness of the pipeline assembly and the ability to approach more closely, at the change of direction, to a wall or similar obstruction, for example.

Formation of elbows is by a variety of processes depending, amongst other things, on the material from which it is to be formed. Thus, metal elbows can be cast or forged and then drilled, whilst plastic elbows can be moulded and drilled, or at times formed by injection moulding. However, each of these methods of production incorporates disadvantages. Thus any operation involving casting or forging followed by a drilling operation necessarily involves considerable handling costs as well as resulting in waste of material, whilst injection moulding (and indeed any casting or moulding process) requires a totally different production technique to that used for the production of corresponding pipe or tube.

It is an object of the present invention to overcome or at least substantially reduce the above mentioned disadvantages.

According to one aspect of the invention there is provided apparatus for forming an elbow in a length of pipe comprising two internal die pins each mounted for rotation, as limbs of cranked assemblies about the same axis, the internal die pins being angled with respect to the axis of rotation and meeting each other in surfaces lying in a plane normal to the axis of rotation, the surfaces being intersected by said axis of rotation; means for contra-rotating the cranked assemblies from a position at which the die pins are co-axial to a position at which they are aligned at a pre-determined angle with respect to each other.

According to another aspect of the present invention there is provided a method of forming an elbow in a length of pipe comprising inserting internal die pins one into each end of the pipe such that they meet at mutually inclined surfaces at their inner ends; and turning the internal die pins with respect to each other by means of a contra-rotating crank mechanism such that the inclined surfaces continue to abut, whereby to bend the pipe at the interconnecting inclined surfaces until the pipe is at the required pre-determined angle.

We have found that by means of the invention elbows can be formed from tubular stock of any appropriate material. Such an arrangement has the consequent advantage that elbows can be formed e.g. in a pipe or tube forming plant and that no separate and different elbow forming process is necessitated.

The invention as hereinabove defined can be applied to any basically flowable material such as thermoplastic materials or metals, such as copper and brass, and is particularly applicable with respect to steel. With some materials, particularly with harder materials such as steel, external die members may be used in conjunction with the internal die pins, the arrangement being such that as the internal die pins are moved to bend the tube fitted thereabout, appropriately shaped external die members follow and support the bending tube, and may be arranged totally to enclose and support the tube once the internal die pins have been moved to achieve the required predetermined angle of the elbow. Thus it will be seen that such external die members have an increasing effect upon the tube during formation of the elbow.

In a preferred form of the invention, the arrangement is such that the crank assemblies carrying the internal die pins are always arranged to contra-rotate such that each moves through 90°, the angle of the elbow being determined by the angle of the internal die pins with respect to the axis of rotation of the crank assemblies. In one embodiment adjustable angle elbows can be obtained by having facility for varying the angle of the internal die pins as hereinabove mentioned, together with a facility for varying the separation of the cranked assemblies to ensure that the juxtaposed surfaces of the internal die pins meet on the axis of rotation of the crank assemblies.

In order to achieve the necessary movement and flow of the material of the tube during the elbow formation step, lubrication of the surfaces of the internal die pin, and if used the external die members, may be necessary. Such lubrication is preferably by means of a pumped liquid injected for example through appropriate ports applied to the internal die pins and the external die members (where used) or can be by means of solid material which may be a mineral such as graphite, or where the material of the tube is at an elevated temperature, glass. The relevant die surfaces may be coated with an appropriate lubricating material prior to use of the arrangement.

The tube can be at an elevated temperature during formation of the elbow to assist material flow. Thus steel tube could be heated to a temperature not exceeding its melting point provided the die members were of appropriate hard heat resisting material. Facility can be included for heating the tube during formation of the elbow for example by an induction means.

Flow of the material of the tube to assist in the formation of the elbow can be increased by applying an axial force inwardly to the tube during rotation of the crank assemblies i.e. during formation of the elbow. Such axial force may be provided by means of sleeves mounted upon the internal die pins. These sleeves may be forced inwardly by hydraulic or similar means. Alternatively actual movement of the sleeves may not in some circumstances be necessary, rotation of the cranks causing the sleeves to apply adequate axial force during the shaping of the elbow.

In order that the invention may be more readily understood one embodiment thereof will now be described by way of example with reference to the accompanying drawings in which.

Figure 1:
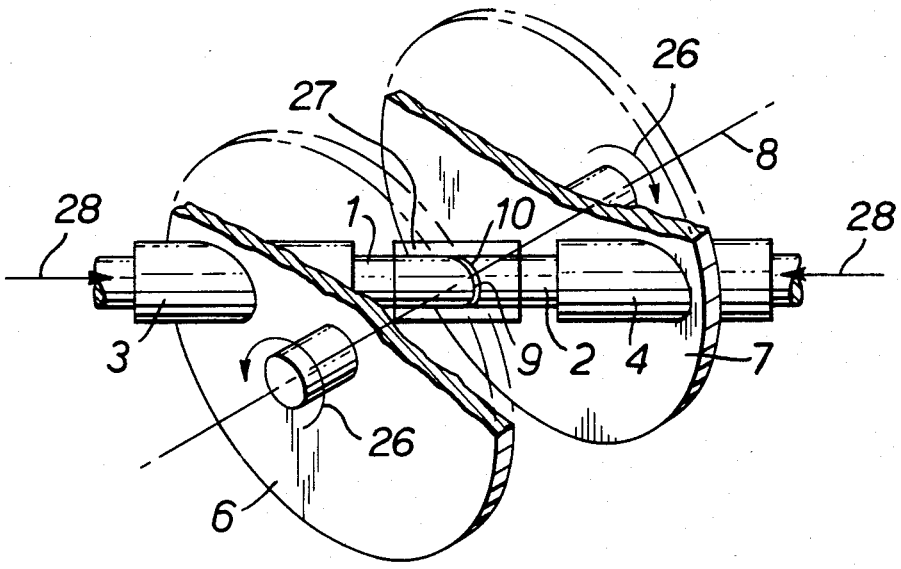
FIG. 1 is a schematic view illustrating operation of apparatus in accordance with the invention shown in its initial position prior to operation.
Figure 2:
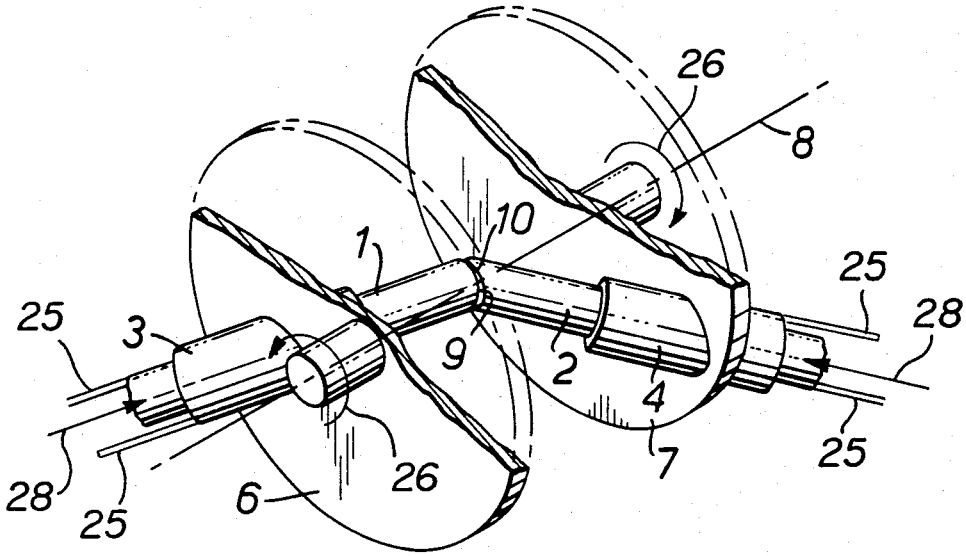
FIGS. 2 and 3 illustrate the apparatus of FIG. 1 in intermediate positions during the formation of an elbow.
Figure 3:
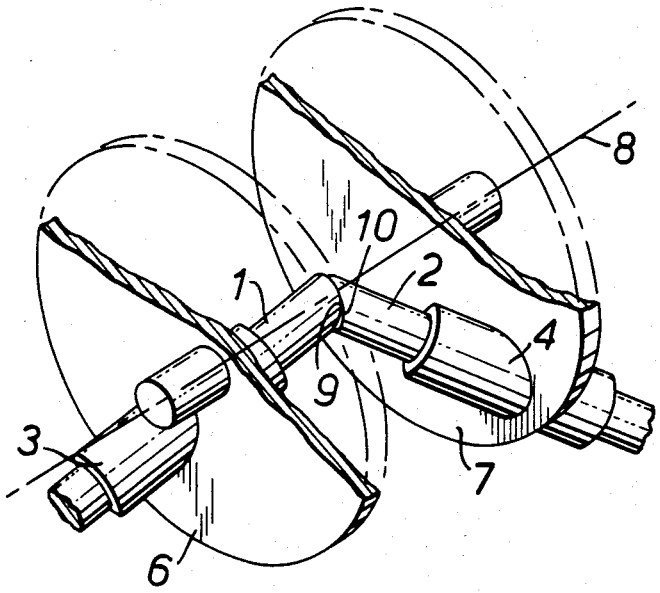

Referring to FIG. 1 it will be seen that two internal die pins 1, 2 mounted on sleeves 3,4 are carried by discs 6,7 aligned parallel with each other and rotatable about a common axis 8. The pins and their associated sleeves are disposed in the plane of the discs such that rotation of the discs causes a crank like movement of the sleeves and pins. In the embodiment illustrated the pins and their associated sleeves are at 45° to the crank discs.

The internal die pins meet at mating surfaces 9,10 of oval configuration parallel to the planes of the discs and in the axis of rotation thereof.

In practice the pins and their sleeves are withdrawn such that a length of tube of steel, for example, is fitted between the two crank discs, the internal die pins are then introduced into the tube and the sleeve members abutted against the ends of the tube. It is to be noted that the tube has end faces cut symmetrically at one or more angles to the tube axis such that the shortest distance between the end faces is related to the final length of the elbow fitting measured along the intrados of the bend, and/or the greatest length between faces is related to the length measured along the extrados and/or the centre line is related to the length measured along the centre line of the elbow.

Some edges of the mating surfaces of the pins are spherically radiused to assist the correct formation of the tube at its final disposition. The inner die pin ends may be mutually supported by means of a suitably profiled cup and cone locator.

Figure 4:
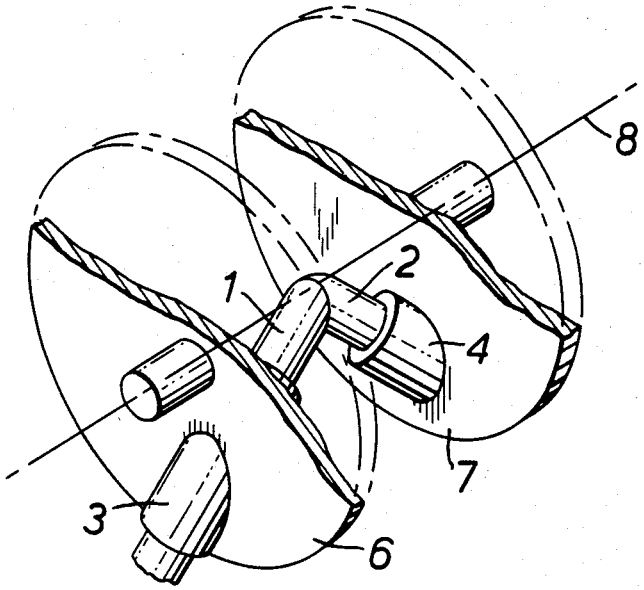
FIG. 4 shows the apparatus of FIG. 1 in its final operating position.

The crank discs are rotated in opposite directions 26 through 90° until the disposition shown in FIG. 4 is attained.

Figure 5:
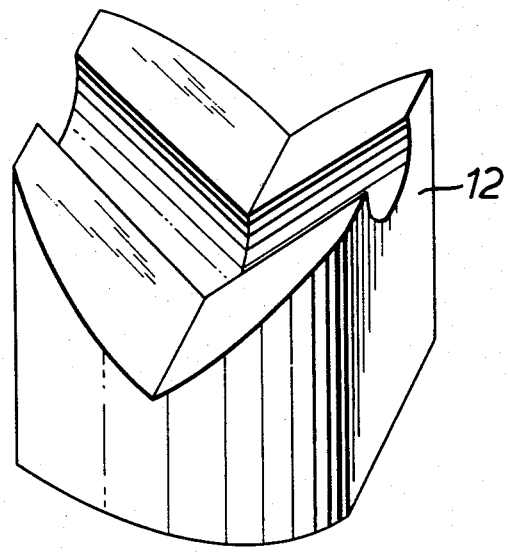
FIGS. 5 and 6 show corresponding external die members for use with the apparatus of FIG. 1.
Figure 6:
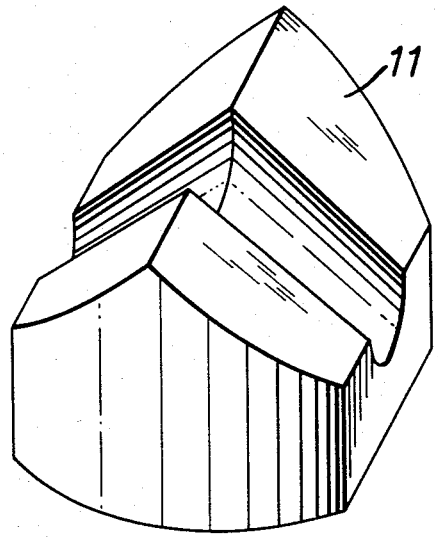

At the same time external co-operating die members 11,12 of the kind illustrated in FIGS. 5 and 6 are applied to the external surface of the tube about the internal die pins, the arrangement being such that at the disposition shown in FIG. 4 the external die members surround and bear upon the tube.

It is to be noted that in the arrangement illustrated bending forces are applied by means of the internal die pins which also control the bore of the elbow formed and by the outer die members moving sympathetically with the internal die pins. Rotation of the crank discs is synchronous with the closing of the other dies or vice versa so that undue deformation of the tube is prevented.

During rotation of the crank discs, the sleeves transfer, from an external means (not shown), an axially inward force 28 upon the tube thereby assisting metal flow at the elbow itself so that the appropriate bending can take place.

Upon reaching the position shown in FIG. 4 the internal die pins and sleeves are removed, and the other dies then opened. An ejector mechanism can be provided to remove the formed elbow fitting from the die.

The arrangement is then rotated in reverse so as to return to the configuration and disposition shown in FIG. 1 ready for the next processing operation.

It will be appreciated that the driving arrangement for the rotational movement and the movement of the other dies is most conveniently linked, and the driving force can be hydraulic power or any other suitable motive force.

Induction means 27 may be included for heating the tube during formation of the elbow as previously described. Ports 25 to the die pins and sleeves may also be provided for injection of a pumped liquid for lubrication of the surfaces of the die pins and sleeves, as previously described.

Figure 7:
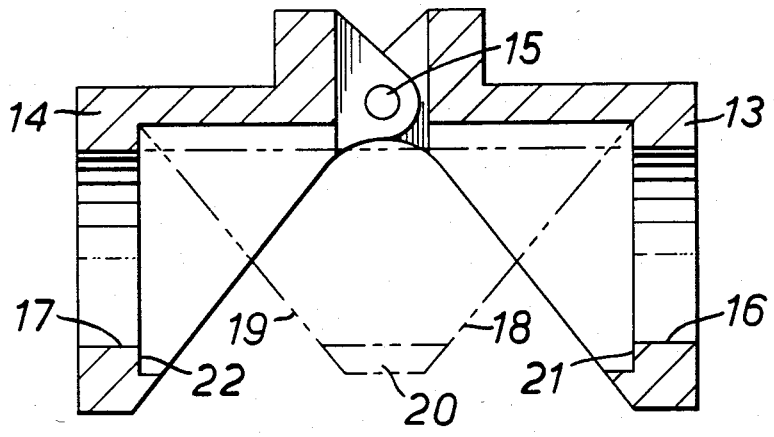
FIGS. 7 and 8 show an alternative form of external die member for use with the apparatus of FIG. 1.
Figure 8:
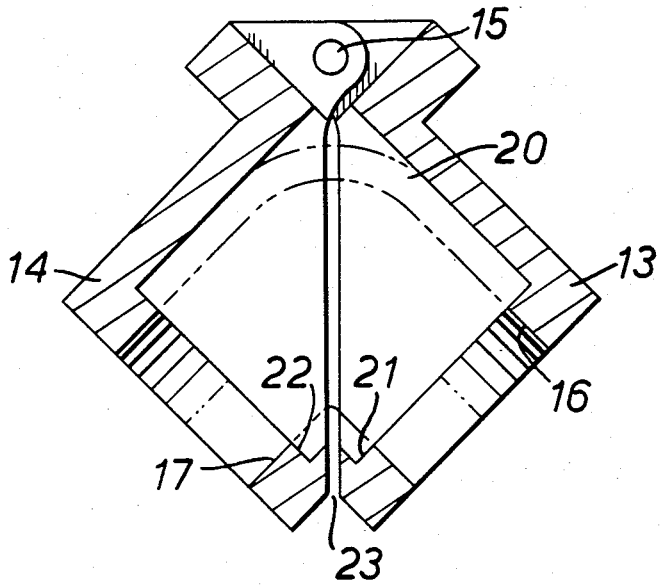

As an alternative to the external dies illustrated in FIGS. 5 and 6 a hinged device as illustrated in FIGS. 7 and 8 can be used. The device has two generally cylindrical portions 13,14 hingedly connected together at 15. The portions have bores 16,17 corresponding in internal diameter to the internal diameter of the tube to be bent. The internal diameter of the portions as such is the same as the external diameter of the tube to be bent.

In operation a tube 20 having inclined end faces 18,19 is fitted into the device set in the disposition shown in FIG. 7 with the end walls 18,19 of the tube abutting against shoulders 21,22 of the device.

As the bending force is applied by the internal die pins so movement is transmitted to the hinged device which of necessity follows the workpiece. During the cycle an increasing part of the tube's end faces 18,19 are contacted by the shoulders 21,22 and so receive axial loading which prevents movement of tube material from the crown of the bend. Upon reaching the position shown in FIG. 8 the shoulders 21,22 will lie in the plane of the end faces 18,19 of the completed elbow.

When the position shown in FIG. 8 is reached the internal die pins are removed and the elbow, still encased in the hinged device is removed. The hinge pin is then extracted and the portions 13 and 14 removed from about the elbow ready for use with the next tube to be bent.

In practice it has been found beneficial to use, additionally, a thin knife like former having a concave semicircular end face on the inside of the bend such that in the final position of FIG. 8 it locates in the gap 23 between the portions 13,14. Such a former prevents extrusion of tube material into the gap 23, the gap being required for ease of movement of the device.

We claim:

1. Apparatus for forming an elbow in a length of pipe comprising two internal die pins each mounted for rotation as limbs of cranked assemblies, about the same axis, said crank assemblies comprising crank discs adapted for contra-rotation from a position at which the die pins are co-axial to a position at which they are aligned at a pre-determined angle with respect to each other, the internal die pins being angled with respect to the axis of rotation and meeting each other in surfaces lying in a plane normal to the axis of rotation, the surfaces being intersected by said axis of rotation.

2. Apparatus as claimed in claim 1 wherein the crank discs are arranged to contra-rotate in operation such that each moves through 90°.

3. Apparatus as claimed in claim 1 including external die members arranged to be used in conjunction with the internal die pins such that in use as the internal die pins are moved to bend the pipe thereupon, the external die members follow and support the bending pipe.

4. Apparatus as claimed in claim 1 including means for lubricating the die members.

5. Apparatus as claimed in claim 1 including means for heating the pipe during bending.

6. Apparatus as claimed in any one of the preceding claims including means for applying an axial force to the pipe during bending.

7. A method of forming an elbow in a length of pipe comprising inserting internal die pins one into each end of the pipe such that they meet at mutually inclined surfaces at their inner ends; and turning the internal die pins with respect to each other by means of a contra-rotating crank mechanism such that the inclined surfaces continue to abut, whereby to bend the pipe at the inter-connecting inclined surfaces until the pipe is at the required pre-determined angle.

8. A method as claimed in claim 7 including the step of lubricating the die members during bending of the pipe.

9. A method as claimed in claim 7 including the step of heating the pipe during bending.

10. A method as claimed in claim 8 including the step of applying an axial force to the pipe during bending.

* * * * *